US009335132B1

(12) United States Patent
Collier

(10) Patent No.: US 9,335,132 B1
(45) **Date of Patent: *May 10, 2016**

(54) SWEPT HEMISPHERICAL PROFILE AXISYMMETRIC CIRCULAR LINEAR SHAPED CHARGE

(71) Applicant: Innovative Defense, LLC, Smithville, TX (US)

(72) Inventor: Nicholas Collier, Smithville, TX (US)

(73) Assignee: Innovative Defense, LLC, Smithville, TX (US)

( * ) Notice: Subject to any disclaimer, the term of this patent is extended or adjusted under 35 U.S.C. 154(b) by 223 days.

This patent is subject to a terminal disclaimer.

(21) Appl. No.: 14/181,282

(22) Filed: Feb. 14, 2014

Related U.S. Application Data

(60) Provisional application No. 61/765,656, filed on Feb. 15, 2013.

(51) Int. Cl.
*F42B 1/00* (2006.01)
*F42B 1/028* (2006.01)

(52) U.S. Cl.
CPC ..... *F42B 1/028* (2013.01)

(58) Field of Classification Search
USPC ..... 102/307, 318; 175/2; 166/55.2
See application file for complete search history.

(56) References Cited

U.S. PATENT DOCUMENTS 2,757,611 A 8/1956 Church et al.
2,796,833 A 6/1957 Sweetman
2,804,823 A 9/1957 Jablansky
3,302,567 A 2/1967 Venghiattis
3,561,361 A 2/1971 Kessenich et al.
3,721,192 A 3/1973 McEwan et al.
3,838,644 A 10/1974 Prochnow et al.
3,903,803 A 9/1975 Losey
3,908,933 A 9/1975 Goss et al.
4,300,453 A 11/1981 Bigler
4,313,380 A 2/1982 Martner et al.
4,342,262 A 8/1982 Romer et al.
4,425,850 A 1/1984 Grossler
4,430,939 A 2/1984 Harrold
4,441,428 A 4/1984 Wilson
4,450,768 A 5/1984 Bell
4,551,287 A 11/1985 Bethmann
4,632,036 A 12/1986 Ringel
4,643,097 A 2/1987 Chawla et al.
4,665,826 A 5/1987 Marer
4,669,386 A 6/1987 Precoul et al.
4,672,896 A 6/1987 Precoul et al.

(Continued)

FOREIGN PATENT DOCUMENTS

GB 2246621 5/1992

*Primary Examiner* — J. Woodrow Eldred
(74) *Attorney, Agent, or Firm* — Hemingway & Hansen, LLP; D. Scott Hemingway

(57) ABSTRACT

In the hemispherical family of axisymmetric circular linear shaped charge liners, this novel swept hemispherical profile shaped explosive device produces a stable jet with the ability to aim the jet by moving the initial explosive impulse ring on the liner surface inward or outward from the pole of the liner profile. The precision of the circular simultaneous initiation of the HE billet is accomplished by the use of a novel Circular Precision Initiation Coupler (CPIC). This CPIC uses a single point initiation to create a simultaneous peripheral detonation of the HE billet that collapses and drives the swept liner into a high speed stretching hollow cylindrical projectile, or more commonly called a jet in the industry.

25 Claims, 1 Drawing Sheet

(56) References Cited

U.S. PATENT DOCUMENTS

| | | | | | |
|---|---|---|---|---|---|
| 4,688,486 | A | | 8/1987 | Hall et al. | |
| 4,759,886 | A | | 7/1988 | Daugherity | |
| 4,833,994 | A | | 5/1989 | Strobush | |
| 4,841,864 | A | | 6/1989 | Grace | |
| 4,896,609 | A | | 1/1990 | Betts et al. | |
| 4,982,665 | A | | 1/1991 | Sewell et al. | |
| 4,989,517 | A | | 2/1991 | Adimari et al. | |
| 5,003,884 | A | | 4/1991 | Nissl et al. | |
| 5,078,069 | A | | 1/1992 | August et al. | |
| 5,088,416 | A | | 2/1992 | Sabranski | |
| 5,235,128 | A | | 8/1993 | Hardesty et al. | |
| 5,245,927 | A | | 9/1993 | Ranes | |
| 5,251,561 | A | | 10/1993 | Murphy | |
| 5,269,223 | A | | 12/1993 | Mattsson et al. | |
| 5,279,228 | A | * | 1/1994 | Ayer | F42B 1/032 102/306 |
| 5,320,044 | A | | 6/1994 | Walters | |
| 5,522,319 | A | * | 6/1996 | Haselman, Jr. | F42B 1/028 102/306 |
| 5,621,185 | A | | 4/1997 | Spengler et al. | |
| 5,753,850 | A | | 5/1998 | Chawla et al. | |
| 5,847,312 | A | | 12/1998 | Walters et al. | |
| 5,988,071 | A | | 11/1999 | Taylor | |
| 6,179,944 | B1 | | 1/2001 | Monolo et al. | |
| 6,354,219 | B1 | | 3/2002 | Pratt et al. | |
| 6,443,068 | B1 | | 9/2002 | Meister | |
| 6,477,959 | B1 | | 11/2002 | Ritman et al. | |
| 6,644,205 | B2 | | 11/2003 | Ritman et al. | |
| 6,668,726 | B2 | | 12/2003 | Lussier | |
| 6,758,143 | B2 | | 7/2004 | Ritman et al. | |
| 6,792,866 | B2 | | 9/2004 | Grattan | |
| 6,840,178 | B2 | | 1/2005 | Collins et al. | |
| 7,261,036 | B2 | | 8/2007 | Bourne et al. | |
| 7,621,221 | B2 | | 11/2009 | Ritman | |
| 7,753,850 | B2 | | 7/2010 | Averkiou et al. | |
| 7,779,760 | B2 | | 8/2010 | Konig | |
| 7,810,431 | B2 | | 10/2010 | Heine et al. | |
| 7,819,064 | B2 | | 10/2010 | Saenger et al. | |
| 8,375,859 | B2 | | 2/2013 | Sagebiel | |
| 2003/0183113 | A1 | | 10/2003 | Barlow et al. | |
| 2005/0188878 | A1 | | 9/2005 | Baker et al. | |
| 2006/0107862 | A1 | | 5/2006 | Davis et al. | |
| 2008/0011179 | A1 | | 1/2008 | Michel et al. | |
| 2008/0134925 | A1 | | 6/2008 | Konig | |
| 2008/0289529 | A1 | | 11/2008 | Schilling | |
| 2009/0211481 | A1 | | 8/2009 | Schwantes et al. | |
| 2011/0232519 | A1 | | 9/2011 | Sagebiel | |
| 2013/0199394 | A1 | | 8/2013 | Collier | |

* cited by examiner

SWEPT HEMISPHERICAL PROFILE AXISYMMETRIC CIRCULAR LINEAR SHAPED CHARGE

RELATED APPLICATION DATA

This application is a non-provisional application which claims the benefit of U.S. Provisional Application No. 61/765,656, filed Feb. 15, 2013.

TECHNICAL FIELD OF INVENTION

This invention relates to shaped charges and in particular to a swept hemispherical profile shaped explosive device that produces a full caliber or greater hole, that is to say a hole as large as the explosive charge diameter (CD).

BACKGROUND OF THE INVENTION

Shaped charges come in many sizes and shapes and are used mainly for military weaponry and oil well perforating; to a lesser extent demolition and rescue are also users of this complex technology.

The concept of shaping an explosive charge, in order to focus its energy was known in 1792. ("The History of Shaped Charges" Donald R Kennedy)

In 1884 Max von Foerster conducted experiments in Germany showing that a hollow cavity explosive charge will focus the explosive energy and produce a collimated jet of high speed gasses along the longitudinal axis of the cavity, this jet also could penetrate steel.

In 1888, while conducting research for the U.S Navy, at Newport R.I., Charles Munroe discovered that not only could explosive energy be focused, but lining the hollow cavity in the explosive with metal increased the penetration dramatically, the effect is commonly called the Munroe effect.

These discoveries were further studied in 1910 by Egon Neumann of Germany who conducted similar experiment's, which showed that a cylinder of explosive with a metal lined conical hollow cavity could penetrate through steel plates. The military implications of this phenomenon were not realized until the lead up to world war two.

In the 1930's flash x-ray technology was developed which allowed the in depth study of the Shaped Charge jetting process. With this new and other diagnostics, it was possible to take XRay pictures of the collapse of the liner and the resulting jet. This led to a more scientific and complete understanding of the Munroe principle and emphasized the power of shaped charges.

Modern shaped charges as used in anti-tank weapons produce a long stretching rod like metal jet that penetrates about 5 to 8 charge diameters in steel, deeper in masonry or rock. The average diameter of a 5 CD through hole in steel from these charges is less than 15% of the explosive charge diameter (CD) of the device. The holes made by these jets do not provide sufficient diameter to allow follow on or follow through devices to pass into the perforation and add to the hole depth.

There have been some specialized efforts by Haliburton to produce other than conical type shaped charges for special purposes such as pipe cutting and anchor chain cutting. These types of charges are called linear shaped charges and use the two dimensional collapse to produce a thin sheet like jet with somewhat similar cutting power to the usual conical shaped charge. These linear shaped charges are flexible and can be formed by hand into desired shapes. The British Wall AXE circa 1960 is an example of a formable linear shape charge with a wide angle liner; the device is used against light structures such as wooden doors and thin walls and do not give very deep penetration.

Throughout the history of shaped charges the primary effort of research in this field was directed toward depth of penetration by the jet. Although hole size was considered in the past, little research has been done on significantly increasing jet diameter and cross-sectional shape of the jet to produce a larger hole diameter. In oil field applications a larger hole is most desirable as the flow area of the hole increases rapidly with an increase in hole diameter. With the ability to produce a full caliber hole, a follow on or follow through device can be deployed into the hole to the correct standoff from the bottom of the hole. When detonated at the correct standoff this will increase the hole depth by that of the primary hole producing device, this can be repeated numerous times in the same hole.

In the case of oil well stimulation the ability to place lined shaped charges into the formation outside of a casing, not only increases hole depth but blast affects from the HE fractures the local rock increasing its permeability and flow rate. Many other industries can benefit from this innovation from Military to Mining so the motivation to pursue the concept of producing a full caliber hole with a shaped charge is to provide new means to these industries.

SUMMARY OF INVENTION

The swept profile designs of the swept hemispherical profile axisymmetric circular linear shaped charge (ACLSC) will efficiently remove more target material than a rod producing shaped charge. This increase in efficiency is achieved by making a much larger diameter jet. To produce a significantly larger jet one must consider focusing the energy of the jetting liner in a much larger pattern than that of a conventional shaped charge. This large diameter jet is achieved by detonating the high explosive (HE) billet, which is a mass of high explosive, thereby forming the liner into a stretching hollow cylindrical jet. This jet being close to the same diameter as the device forms a hole larger than the device diameter and removes the full device diameter of the target material.

The swept hemispherical profile (SHP) liner family will produce a slower but more massive jet when compared to a swept conical design, but the SHP liner forms a stable jet with the ability to aim the jet by moving the initial explosive impulse ring on the liner surface inward or outward from the pole of the liner profile.

The precision of the circular simultaneous initiation of the HE billet is accomplished by the use of a novel Circular Precision Initiation Coupler (CPIC). The CPIC initiation system is a single point to ring or peripheral initiation and is mated to the aft end of the HE billet and centered by the outer body so as to align the CPIC output with the pole axis of the liner. As the detonation wave reaches the intersection of the collapse axis and pole of the liner the enormous detonation pressures cause the pole material of the liner to accelerate forward and the inner and outer walls to elongate along the collapse axis forming the walls of the stretching hollow cylindrical projectile, or more commonly called a jet in the industry.

BRIEF DESCRIPTION OF THE DRAWINGS

Because of the complexity of shapes involved, the inventor will use descriptive drawings and text to describe the device and how it functions.

DETAILED DESCRIPTION

Figure 1:
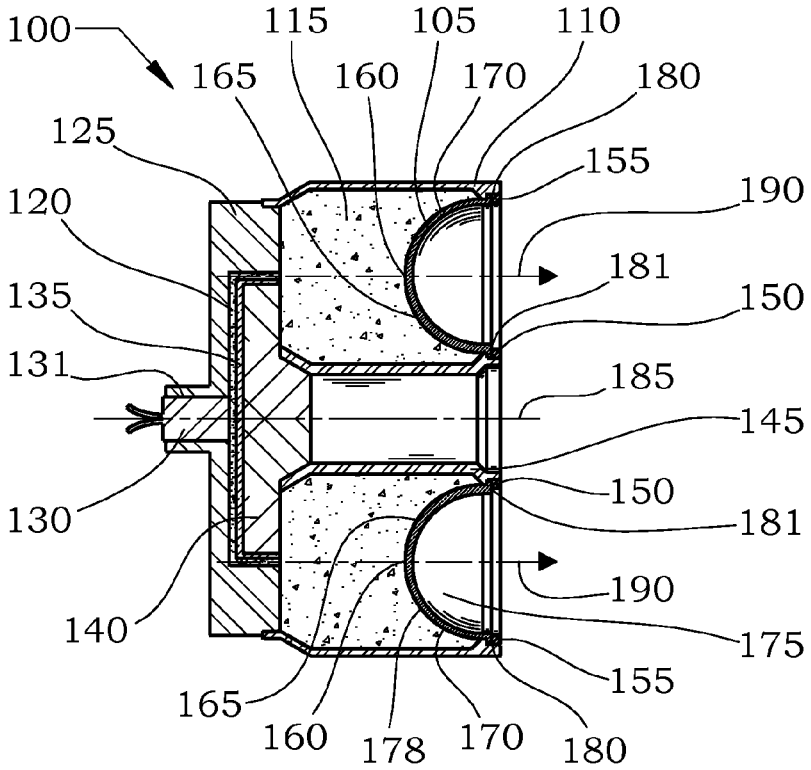
FIG. 1 is a cross-sectional view of a swept hemispherical shaped charge device (SHSC).

The swept profile designs of the swept hemispherical profile axisymmetric circular linear shaped charge (ACLSC) will efficiently remove more target material than a rod producing shaped charge. This increase in efficiency is achieved by making a much larger diameter jet. To produce a significantly larger jet one must consider focusing the energy of the jetting liner in a much larger pattern than that of a conventional shaped charge. This large diameter jet is achieved by detonating the high explosive (HE) billet, which is a mass of high explosive, thereby forming the swept liner profile into a stretching hollow cylindrical jet. This jet being close to the same diameter as the device forms a hole larger than the device diameter and removes the full device diameter of the target material.

Although the ACLSC charge will not penetrate as deep as a conventional shaped charge it will remove a full charge diameter of material, which allows the SHP to remove far more material volume than a much deeper penetrating conventional shaped charge device.

Since ACLSC devices produce, full caliber holes it is possible to send follow on charges into the penetration deepening the hole and sending the debris out of the hole at high velocity. Follow on charges are not possible with traditional shaped charges since the penetration hole is very much smaller than the charge diameter which prevents the next charge from obtaining the correct standoff from the bottom of the hole. Oil and gas well completions and military users will benefit greatly from the use of ACLSC devices which is the goal of this shaped charge concept and development.

This novel swept hemispherical profile axisymmetric circular linear shaped charge (ACLSC) differs from a conventional lined shaped charge device, in that the ACLSC produces a large diameter hollow cylindrical jet as opposed to a rod like jet from a conventional lined shaped charge. This large diameter hollow jet will produce a full caliber or greater sized hole. This full caliber hole capability allows for a follow on or follow through devices of equivalent diameter to be placed at the correct standoff, in the hole produced by first said device. The ability to place secondary and tertiary devices in said hole allows the hole to be increased in depth with each device detonation in an infinite target. The uses and advantages of this innovation in shaped charge design are many in both military and commercial applications.

The ACLSC device produces a parallel, converging, or diverging jet relative to the axis of symmetry, and is capable of removing the full diameter of material without leaving a center plug of target material to a semi-infinite depth by the repeated use of follow on devices.

The liner profile names, represent the two dimensional (2D) profile that would be seen if a hollow hemisphere were cut sagittal along the longitudinal axis of the hemisphere creating a hollow half hemisphere. This hollow half hemisphere profile is swept about the central axis of symmetry of the device leaving a through hole in the center providing for a central body that serves as inner high explosive (HE) containment, expansion path for detonation gasses, space for shock absorption materials, and can also contain a central projectile producing device.

To simplify the description of the geometry, detonation and collapse of a SHP liner we could look only at 2D profile of the swept liner shape and other device components as if the charge was cut sagittal through the axis of symmetry. This cut will show the liner profile that makes the hollow toroid with an inner and outer wall joined at the pole or collapse axis of the curvature. The collapse axis that passes through the apex of swept liner is visually an axis when viewing it in a 2D profile, but in reality it is not a true axis. If viewed in three dimensional (3D) space, this collapse axis would be seen as a hollow cylinder with a diameter equal to the pole diameter of the liner extending through the length of the device and coaxial to the device axis of symmetry. For ease of discussion, the 2D term collapse axis will be used to describe the 3D hollow cylinder that the liner collapses on.

The swept profile of a hollow hemisphere, cut through the pole by a plane, as seen from an equatorial view, is revolved or swept about a central axis of symmetry. This sweeping or revolving of the profile forms a hollow half torus or circular trough liner with a semicircular cross section. This liner has an outer diameter and an inner diameter and a pole axis or collapse axis at the pole of the hemispherical profile and parallel to the axis of symmetry. The description above would designate a hole in the center formed by the inner wall of the circular liner.

It is not intended to imply that round or circular configuration is the only form this peripheral lined shaped charge can have. The HE initiation simultaneity, from a single point to a periphery for other shapes such as ellipsoids, square, rectangle even a closed spline configuration is much more complex than the round form.

The swept hemispherical profile (SHP) liner family will produce a slower but more massive jet when compared to a swept conical design, but the SHP liner forms a stable jet with the ability to aim the jet by moving the initial explosive impulse ring on the liner surface inward or outward from the pole of the liner profile. In one of a number of preferred configurations this novel swept profile shaped explosive device produces a stretching hollow cylindrical jet. The afore mentioned jet is formed by the pressures created by the detonation of the high explosive (HE) billet in a circular pattern at the aft end of the billet and aligned with pole axis of the swept liner profile.

The capability of the SHP liner device to produce a super caliber hole allows follow on devices of the same caliber to theoretically produce the hole to infinite depths. This novel axisymmetric SHP shaped explosive device differs from a conventional lined shaped charge in that the SHP liner device produces a large diameter hollow cylindrical jet as opposed to a rod like jet from a conventional lined shaped charge. The uses and advantages of this innovation in shaped charge design are many in both military and commercial applications.

This ACLSC device consists of a swept hemispherical profile (SHP) liner, a HE billet, an outer body, an inner body, an initiation system and shock attenuation components. Commercial or Military versions of this device could be tailored to the task or demand from the industry. The ACLSC is interfaced to an appropriately shaped quantity of high explosive (HE), having provisions for a precision initiation train, HE containment, and tamping of HE if desired.

The swept hemispherical profile (SHP) liner for this application looks like a length of thin walled tubing formed into a circle and cut across the equatorial diameter like a hollow half torus with a through hole formed by the inner wall diameter. The liner also has a polar axis and a through hole at its center. This through hole provides for the inner body and shock attenuation materials and is about one third the diameter of the liner's outer mounting diameter. The SHP liner could be described as a hollow half torus, though hollow half toroid's can have any contour or profile.

Preferably the SHP liner uses a copper material, but liners may be made from most any metal, ceramic, powdered metals, tungsten, silver, copper or combination of many materials. The intent here is to develop the concept of this circular linear swept profile shaped charge not the liner material.

The HE Billet in its most basic form is a right circular cylinder having a through hole at its center leaving a wall thickness greater than the annulus width (AW) between the inside and outside diameters of the liner. The billet is of sufficient length to provide adequate head height of HE above the liner surface so there is sufficient HE to drive the liner in the desired fashion. The wall of the HE billet has a concentric swept concavity at its front end matching the outside convex surface of the liner, in size and contour. The wall thickness of the HE being larger than the annulus width provides for super caliber explosive all the way to the equator of the half torus or circular hollow trough. This makes for higher jet velocities, more jet mass, longer jet and better penetration performance. The liner is inserted snugly into the concavity of the HE billet, making a liner HE sub assembly of the device. The SHP liner device can use cast, pressed, extruded or even hand packed HE from any high quality explosive.

The swept profile liner configurations included in this embodiment are: Hemispherical with constant liner wall thickness (SHPCW), and Hemispherical with varying liner wall thickness (SHPVW), in relation to the inside and outside surfaces of the liner trough or half torus shell.

To initiate a swept profile shaped charge the HE billet detonation should be initiated by a simultaneous ring detonation from a Circular Precision Initiation Coupler (CPIC). The CPIC initiates detonation of the HE billet in a circular pattern at the aft end of the HE billet and at the exact diameter of the pole of the swept liner profile. The precision of the circular simultaneous initiation of the HE billet is accomplished by the use of a novel Circular Precision Initiation Coupler (CPIC). The CPIC initiation system is a single point to ring or peripheral initiation and is mated to the aft end of the HE billet and centered by the outer body so as to align the CPIC output with the pole axis of the liner. As the detonation wave reaches the intersection of the collapse axis and pole of the liner the enormous detonation pressures cause the pole material of the liner to accelerate forward and the inner and outer walls to elongate along the collapse axis forming the walls of the stretching hollow cylindrical jet. This CPIC uses a single point initiation to create a simultaneous peripheral detonation of the HE billet that collapses and drives the SHP liner into a high speed stretching hollow cylindrical projectile, or more commonly called a jet in the industry. The CPIC can be used with many swept liner geometries, and tailored to the desired size and shape required.

The jetting trajectory of this SHP liner device can be aimed other than parallel to the symmetrical axis of the device just by a changing the angle of attack of the detonation wave relative to the pole axis of the liner. This is done by changing the diameter and angle of the CPIC initiation of the HE billet so the detonation front engages the liner surface at either a larger or smaller diameter than the collapse axis and tangentially to the liner curvature.

To produce a straight axisymmetric hollow cylindrical jet about the symmetrical axis of the SHP liner device it is necessary to balance the explosive gas pressures and the inner and outer liner wall masses. The liner wall masses can be balanced by adjusting the wall thickness on either side of the pole at the collapse axis of the liner, these liner wall masses differ due to large volume increase as the diameter of the liner wall increases. The HE mass also increases greatly with a diameter increase and needs to be balance correctly to the given liner mass. Adequate charge to mass ratios of explosive to liner as per Gurney equations should be adhered to as close as the application size restrictions will allow to prevent underdriving or overdriving the liner. The ideal charge to mass ratio can be tricky to obtain for a SHP liner device especially as the device becomes smaller (i.e., a 5 inch SHP liner device has more space or volume between the symmetrical axis and the collapse axis for HE mass balancing than a 2 inch SHP).

As an example of the difference in a conventional shaped charge verses the SHP liner device, the average 2 inch diameter premium oil well perforator shaped charge producing a 35 inch deep tapered hole with a 0.75 inch entrance diameter in a target removes 19.68 cubic inches of material volume. In comparison a 2 inch SHP liner device producing 6 inches of penetration and a 3 inch throughout hole diameter removes 42 cubic inches of target material. The potential for the SHP liner device to produce a 6 inch diameter non-tapered hole with 12 inches or more in penetration depth is there and in time will be developed. Oil and gas well completions and military users will benefit greatly from the use of SHP liner devices which is the goal of this shaped charge concept and development.

To initiate a swept profile shaped charge the HE billet detonation should be initiated by a simultaneous ring detonation from a Circular Precision Initiation Coupler (CPIC). The CPIC initiates detonation of the HE billet in a circular pattern at the aft end of the HE billet and at the exact diameter of the pole of the swept liner profile. The precision of the circular simultaneous initiation of the HE billet is accomplished by the use of a novel Circular Precision Initiation Coupler (CPIC). The CPIC initiation system is a single point to ring or peripheral initiation and is mated to the aft end of the HE billet and centered by the outer body so as to align the CPIC output with the pole axis of the liner. As the detonation wave reaches the intersection of the collapse axis and pole of the liner the enormous detonation pressures cause the pole material of the liner to accelerate forward and the inner and outer walls to elongate along the collapse axis forming the walls of the stretching hollow cylindrical jet. This CPIC uses a single point initiation to create a simultaneous peripheral detonation of the HE billet that collapses and drives the SHP liner into a high speed stretching hollow cylindrical projectile, or more commonly called a jet in the industry. The CPIC can be used with many swept liner geometries, and tailored to the desired size and shape required.

The jetting trajectory of this SHP liner device can be aimed other than parallel to the symmetrical axis of the device just by a changing the angle of attack of the detonation wave relative to the pole axis of the liner. This is done by changing the diameter and angle of the CPIC initiation of the HE billet so the detonation front engages the liner surface at either a larger or smaller diameter than the collapse axis and tangentially to the liner curvature.

Detonation shock wave control is very important to form stable jetting from shaped charges. Reflected shock waves can negatively affect jet formation and the overall performance of the shape charge. The SHP lined device in this embodiment has various features incorporating irregular shaped solids, in the center through hole of the liner and inner body, these shaped solids can be made from low sound speed material such as high density foam, powdered metals and combinations thereof. Since the smaller devices in this SHP liner device offers little room in the center hole in the HE billet, measures must be taken to break up, absorb and attenuate the shock from HE detonation in this region for sufficient time for the jet to form.

In order to take advantage of the penetrating power of a shaped charge to produce a full caliber hole, it is necessary to concentrate the energy of the jetting material in a different pattern than that of a conventional shaped charge, such as spreading the energy into a large diameter circle, thus the need for a Swept hemispherical profile design.

Herein disclosed is an axisymmetric circular linear shaped charge device. The shaped charge device has a liner configured in a partial toroid with a longitudinal axis intersecting an aperture located near the center of the partial toroid. The partial toroid being open-ended on a plane that intersects the longitudinal axis in a perpendicular manner toward a front end of the shaped charge device. The liner having a hollow hemispherical cross-section extending toward a closed end of the partial toroid as defined by a longitudinal plane that is aligned on the longitudinal axis and a pole of the hemispherical cross-section at a closed end of the partial toroid that extends toward a rear end of the shaped charge device. The liner having an outer surface and an inner surface with the inner surface exposed toward the open end of the front end of the shaped charge device and the liner producing an explosive hollow cylindrical jet stream directed toward the front of the shaped charge device upon detonation of the shaped charge device.

A billet of high explosive material having a front end and a rear end located behind and proximate to the outer surface of the liner and configured as a toroid with an internal aperture located proximate to the aperture of the liner. The billet producing a high explosive detonation effect applied to the liner to produce the hollow cylindrical jet stream. A coupler located in a rear portion of the shaped charge device and coupled to the rear end of the billet and the coupler producing a detonation wave initiating the high explosive detonation effect of the billet.

A body located around the outer surface of the billet and extending longitudinally the length of the billet. The body having a front end secured to the liner and a rear end secured to the coupler. An attenuator located proximate to the aperture in the billet that dampens a detonation wave. A center body located proximate to the aperture of the liner and rearward of the billet toward the rear portion of the shaped charge device.

Herein disclosed is a method of producing an axisymmetric cylindrical jet stream from a circular linear shaped charge device by providing a liner configured in a partial toroid with a longitudinal axis intersecting an aperture located near the center of the partial toroid. The partial toroid being open-ended on a plane that intersects the longitudinal axis in a perpendicular manner toward a front end of the shaped charge device. The liner having a hollow hemispherical cross-section extending toward a closed end of the partial toroid as defined by a longitudinal plane that is aligned on the longitudinal axis and a pole of the hemispherical cross-section at a closed end of the partial toroid that extends toward a rear end of the shaped charge device. The liner having an outer surface and an inner surface with the inner surface exposed toward the open end of the front end of the shaped charge device.

Positioning a billet of high explosive material behind and proximate to the outer surface of the liner and proximate to the aperture of the liner. The billet producing a high explosive detonation effect applied to the liner to produce the hollow cylindrical jet stream. Positioning a coupler at a rear portion of the shaped charge device in contact with the rear of the billet. The coupler producing a detonation wave and initiating the high explosive detonation effect of the billet.

Surrounding the shaped charge device with a body around the outer diameter of the billet and extending longitudinally the length of the billet. Producing an explosive hollow cylindrical jet stream with the liner that is directed toward the front of the shaped charge device upon detonation of the shaped charge device.

Additionally you can provide an attenuator proximate to the aperture in the billet that dampens a detonation wave. Positioning a center body proximate to the aperture of the liner and rearward of the billet toward the rear portion of the shaped charge device.

The swept hemispherical shaped charge (SHSC) 100, having an aft area and a fore area, is shown in FIG. 1 and consists of a swept hemispherical profile (SHP) liner 105, a body 110, a high explosive (HE) billet 115 which is a mass of high explosive, a Circular Precision Initiation Coupler (CPIC), an explosive shock attenuator (ESA) 140, a center body 145, an inner retaining ring 150, and an outer retaining ring 155. All components of device 100 share a common symmetrical axis 185.

The SHP liner 105, located about the fore area of the SHSC, is the working material of the shaped charge and will be optimized in thickness, profile and material to produce the desired effects on the target material. Preferably the liner uses a copper material, but liners may be made from most any metal, ceramic, powdered metals, tungsten, silver, copper or combination of many materials.

Figure 1A:
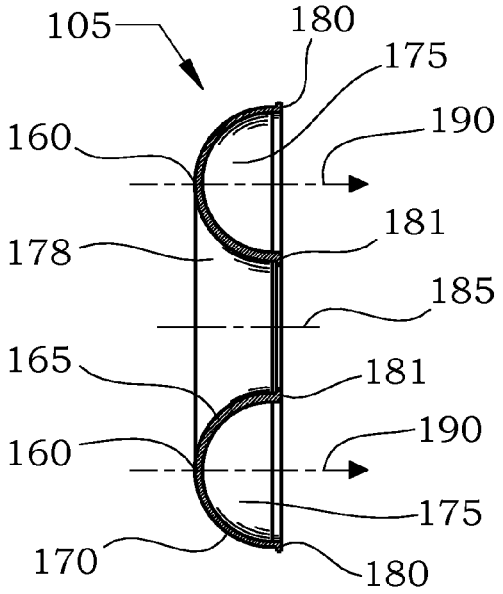
FIG. 1A is a cross-sectional view of a swept hemispherical profile (SHP) liner.

The SHP liner 105, as singularly shown in FIG. 1A, has an inside wall 165, an outside wall 170, a pole 160 an outer base end 180, an inner base end 181, an outer semicircle surface 178, and an inner semicircle surface 175. Outer semicircle 178 and inner semicircle 175 can be concentric to each other or offset centers to tailor the thickness of the inside wall 165 and outside wall 170. Stable jetting can be achieved if the SHP liner 105 wall mass on either side of the pole 160 at the collapse axis 190 is balanced correctly. The mass of a constant wall thickness Liner will increase greatly from the inside diameter (ID) closest to the symmetrical axis 185 to the outside diameter (OD) because of the large volume increase as the diameter of the liner wall increases from the ID to the OD. This can be solved by offsetting the centers of outer semicircle 178 to inner semicircle 175 making the inside wall 165 thicker than the outside wall 170 to achieve equal liner wall mass on both sides of collapse axis 190.

Offset semicircle centers will make the thickness of inside wall 165 gradually increase from the pole 160 to the inner base end 181, and the thickness of outside wall 170 gradually decrease from pole 160 to the outer base end 180. The wall thickness is varied in this way to balance the explosive charge to SHP liner 105 mass ratios, which also balances the momentum of the collapse and stretching of the SHP liner 105 walls.

For example, with a 5 inch diameter liner of offset semicircle centers, the inside wall 165 needs to be between 1-3 mm at the pole 160 and taper toward the inner base end 181 to between 2-5 mm. The outside wall 170 must taper the reverse direction from between 1.5-3 mm at the pole 160 and tapering down to between 1-2.5 mm at the outer base end 180. These dimensions will be refined with numerical code and experiment to give the most tailored jet to address the specific target material. Jet velocities can vary from 4 to 10 km/s depending on the liner material, wall thickness and other geometries. Other thickness profiles of the liner can be utilized to balance liner wall momentums (i.e., making both the inside wall 165 and outside wall 170 into multiple arcs to accomplish the desired profile thickness that will produce the best projectile performance).

The HE billet 115 provides the energy to collapse the SHP liner 105, increases the ductility, and focuses the flowing material causing it to form a long hollow cylindrical stretching very high velocity projectile commonly called a jet. The body 110 provides an outer mounting surface for SHP liner 105 which is held to body 110 by outer retaining ring 155. Body 110 also serves as a containment vessel to protect and hold the shape of the delicate HE billet 115 from damage or impact. Body 110 can provide tamping for HE billet 115 depending on body 110 thickness and material density.

The HE billet 115 in its most basic form is a right circular cylinder having a through hole at its center leaving a wall thickness, or distance from the inside diameter to the outside diameter of the HE billet, greater than the annulus width (AW) between the inside and outside diameters of the liner. The HE billet 115 is of sufficient length to provide adequate head height of HE aft of the liner outer semicircle surface 178 so there is sufficient HE to drive the liner 105 in the desired fashion. The fore end of the HE billet 115 has a concentric swept concavity matching the outer semicircle surface 178 of the liner, which is a convex surface, in size and contour. The thickness of the HE billet 115 being larger than the AW provides for super caliber explosive all the way to the equator of the half torus or circular hollow trough. This makes for higher jet velocities, more jet mass, longer jet and better penetration performance. The liner 105 is inserted snugly into the concavity of the HE billet 115, making a liner/HE sub-assembly of the device. The SHSC device can use cast, pressed, extruded or even hand packed HE from any high quality explosive.

The wall thickness of the HE billet 115 can range from about 0-25% larger than the AW of the SHP liner 105 and still produce a proper jet. If the wall thickness of the liner and the amount of HE used are not correctly matched for the application it will result in an under driven or over driven liner, neither event will produce proper jetting. Adequate charge to mass ratios of HE to liner as per Gurney equations should be adhered to as close as the application size restrictions will allow to prevent underdriving or overdriving the liner.

To initiate a swept profile shaped charge, the HE billet 115 detonation should be initiated by a simultaneous ring detonation from a Circular Precision Initiation Coupler (CPIC). The CPIC, located in the aft area of the SHSC, consists of a CPIC HE 120, charge cover 125, detonator 130, and CPIC HE cover 135. Detonator 130, located about the aft of the CPIC, provides the initial detonation impulse to the shallow cup shaped CPIC HE 120. Charge cover 125 provides a mounting cavity 131 for detonator 130 and CPIC HE 120, and provides the critical alignment of detonator 130 with CPIC HE 120 on the symmetrical axis 185. Charge cover 125 also provides the critical alignment of CPIC HE 120 with HE billet 115, this alignment allows for a precise ring initiation of HE billet 115. Charge cover 125 also serves to cover and protect HE billet 115 and maintains intimate contact of CPIC HE 120 with the HE billet 115. The CPIC function is to transform a single point initiation from detonator 130 into a ring detonation of the CPIC HE 120 that will ring initiate the aft end of the HE billet 115 which is precisely aligned with the collapse axis 190 and pole of SCP liner 105.

The CPIC initiates detonation of the HE billet 115 in a circular pattern at the aft end and at the exact diameter of the pole of the SHP liner 105. The precision of the circular simultaneous initiation of the HE billet 115 is accomplished by the use of a novel Circular Precision Initiation Coupler (CPIC). The CPIC initiation system is a single point to ring or peripheral initiation and is mated to the aft end of the HE billet 115 and centered by the outer body 110 so as to align the CPIC output with the pole axis of the liner 105. As the detonation wave reaches the intersection of the collapse axis 190 and pole 160 of the liner 105, the enormous detonation pressures cause the pole material of the liner 105 to accelerate forward and the inner 165 and outer 170 walls to elongate along the collapse axis 190 forming the walls of the stretching hollow cylindrical jet. This CPIC uses a single point initiation to create a simultaneous peripheral detonation of the HE billet 115 that collapses and drives the SHP liner 105 into a high speed stretching hollow cylindrical projectile, or more commonly called a jet in the industry. The CPIC can be used with many swept liner geometries, and tailored to the desired size and shape required.

The jetting trajectory of this SHP liner 105 can be aimed other than parallel to the symmetrical axis of the device just by a changing the angle of attack of the detonation wave relative to the pole axis of the liner 105. This is done by changing the diameter and angle of the CPIC initiation of the HE billet 115 so the detonation front engages the liner outer semicircle surface 178 at either a larger or smaller diameter than the collapse axis 190 and tangentially to the liner curvature.

To produce a straight axisymmetric hollow cylindrical jet about the symmetrical axis 185 of the SHSC device, it is necessary to balance the explosive gas pressures and the inner 165 and outer 170 liner wall masses. The liner wall masses can be balanced by adjusting the wall thickness on either side of the pole 160 at the collapse axis 190 of the liner 105, these liner wall masses differ due to large volume increase as the diameter of the liner wall increases. The HE mass also increases greatly with a diameter increase and needs to be balance correctly to the given liner mass. Adequate charge to mass ratios of explosive to liner as per Gurney equations should be adhered to as close as the application size restrictions will allow to prevent underdriving or overdriving the liner. The ideal charge to mass ratio can be tricky to obtain for a SHP liner device especially as the device becomes smaller (i.e., a 5 inch SHP liner device has more space or volume between the symmetrical axis and the collapse axis for HE mass balancing than a 2 inch SHP).

The ESA 140 is a shock attenuator made from a low sound velocity material and serves as a detonation wave dampener. Center body 145 supports the inner diameter of HE billet 115, provides space for ESA 140, a path for escaping detonation gases, and other devices (i.e., secondary projectile forming devices). Center body 145 provides an inner mounting surface for SCP liner 105 and aligns it with symmetrical axis 185. SCP liner 105 is held to center body 145 by inner retaining ring 150. Device 100 is capable of producing a hollow cylindrical jet from the SCP liner 105 that will produce a full charge diameter hole in the target.

The center body 145 is encompassed by the explosive charge or main high explosive (HE) billet and can be solid or hollow. The hollow center body 145 being an essential part of the swept profile design could contain shock attenuation materials used to dampen, reflect, and absorb shock waves that would have a detrimental effect on the formation of a stable jet. The hollow center body 145 space can also be used to contain a center projectile producing device or for adjusting HE billet quantity driving the inside wall of the liner, in addition the space can be used to relieve pressure from expanding gasses from the detonation of the HE.

Detonation shock wave control is very important to form stable jetting from shaped charges. Reflected shock waves can negatively affect jet formation and the overall performance of the shape charge. The SHP liner 105 design in this embodiment has various features incorporating irregular shaped solids, in the hollow center body 145. These shaped solids can be made from low sound speed material such as high density foam, powdered metals and combinations thereof. Since the smaller SHSC devices offer little room in the center body 145, measures must be taken to break up, absorb and attenuate the shock from HE detonation in this region for sufficient time for the jet to form.

In order to take advantage of the penetrating power of a SHP ACLSC to produce a full caliber hole, it is necessary to concentrate the energy of the jetting material in a different pattern than that of a conventional shaped charge, such as spreading the energy into a large diameter circle, thus the need for a swept hemispherical profile design. Timing and momentum balancing of the collapsing liner material is critical for jet creation and stability. If the swept liner wall thickness and the amount of explosive used are not correctly matched for the application it will result in an under driven or over driven liner, neither event will produce proper jetting.

FIG. 1A shows the SHP liner 105 that is used in device 100 of FIG. 1. The SHP liner 105 consists of an outer base end 180, inside wall 165, pole 160, inner base end 181, outside wall 170, axis of symmetry 185, collapse axis 190, an outer semicircle 178 and an inner semicircle 175. Collapse axis 190 is shown parallel to the axis of symmetry 185, but can be almost any angle relative to the axis of symmetry 185 that would represent a converging or diverging jet trajectory formed by the focusing of the shaped explosive on the SHP liner 105. The SHP liner 105 is a thin walled half hemispherical profile, swept or revolved about a central symmetrical axis 185. The swept profile having an inside and outside diameter, a radius depth to inner semicircle 175 and outer semicircle 178 along the collapse axis 190, and when revolved about its symmetrical axis 185 it forms a hollow circular trough with a semicircular concavity between the inner and outer diameters. There is a wall thickness to this trough that is proportional to the outside diameter minus the inside diameter of the liner.

Outer semicircle 178 and inner semicircle 175 can be concentric to each other or offset centers to tailor the thickness of the inside wall 165 and outside wall 170. Stable jetting can be achieved if the SHP liner 105 wall mass on either side of the pole 160 at the collapse axis 190 is balanced correctly. The mass of a constant wall thickness Liner will increase greatly from the inside diameter (ID) closest to the symmetrical axis 185 to the outside diameter (OD) because of the large volume increase as the diameter of the liner wall increases from the ID to the OD. This can be solved by offsetting the centers of outer semicircle 178 to inner semicircle 175 making the inside wall 165 thicker than the outside wall 170 to achieve equal liner wall mass above and below the collapse axis 190.

Offset semicircle centers will make the thickness of inside wall 165 gradually increase from the pole 160 to the inner base end 181, and the thickness of outside wall 170 gradually decrease from pole 160 to the outer base end 180. The wall thickness is varied in this way to balance the explosive charge to SHP liner 105 mass ratios, which also balances the momentum of the collapse and stretching of the SHP liner 105 walls. Liner wall momentum balancing will insure that inside wall 165 and outside wall 170 will stretch to approximately the same length and meet at the collapse axis 190 in concert to produce stable jetting. SHP liners are typical easier to balance than swept conical liners and produce more massive jets. Balancing the liner wall momentums should not be held only to the offset method previously described. Other thickness profiles of the liner can be utilized to balance liner wall momentums, i.e., multiple arcs making both the inside wall 165 and outside wall 170 could also be used to accomplish the desired profile thickness that will produce the best projectile performance.

For example, with a 5 inch diameter liner of offset semicircle centers, the inside wall 165 needs to be between 1-3 mm at the pole 160 and taper toward the inner base end 181 to between 2-5 mm. The outside wall 170 must taper the reverse direction from between 1.5-3 mm at the pole 160 and tapering down to between 1-2.5 mm at the outer base end 180. These dimensions will be refined with numerical code and experiment to give the most tailored jet to address the specific target material. Jet velocities can vary from 4 to 10 km/s depending on the liner material, wall thickness and other geometries. Other thickness profiles of the liner can be utilized to balance liner wall momentums (i.e., making both the inside wall 165 and outside wall 170 into multiple arcs to accomplish the desired profile thickness that will produce the best projectile performance).

Figure 1B:
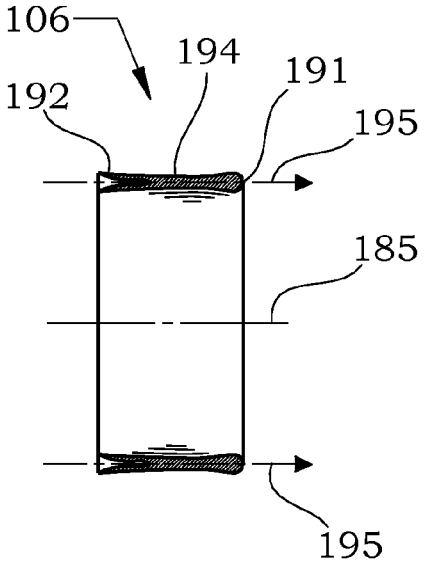
FIG. 1B is a cross-sectional view of a hollow circular jet formed from a SHSC.

FIG. 1B is a cross-sectional view of a typical hollow cylindrical projectile (HCP) 106 produced by a SHP liner device. The HCP 106 consists of a jet 194, jet tail 192, jet tip 191, projection axis 195, and symmetrical axis 185. Jet 194 angle of projection, thickness, length and inside diameter can vary depending on the design of the SHP liner device. The Projection axis 195 is shown parallel to symmetrical axis 185 but could be almost any angle either converging or diverging depending on the SHP liner device design and intended use.

This depiction of HCP 106 is at a finite time after the detonation of a SHSC. The HCP 106 at an earlier time frame after detonation would show the jet 194 shorter in length. At a later time frame, jet 194 would become longer and thinner because of the ductile stretching of the HCP material. The projection axis 195 is shown parallel to symmetrical axis 185 but could be almost any angle either converging or diverging depending on the SHSC design and intended use.

The SHSC is balancing the momentums of the collapsing inner 165 and outer 170 liner walls producing a stable projectile that will remove the full diameter of target material creating a hole without leaving behind a center core. If the momentums of a SHSC are not matched correctly, the jet will not follow the desired trajectory, be of insufficient mass for desired target penetration or not form at all.

The invention claimed is:

1. An axisymmetric circular linear shaped charge device, comprising:

a liner configured in a partial toroid with a longitudinal axis extending lengthwise and intersecting an aperture located near the center of said partial toroid, said partial toroid being open-ended on a plane that intersects said longitudinal axis in a perpendicular manner toward a front end of the shaped charge device, said liner having a hollow hemispherical cross-section extending toward a closed end of the partial toroid as defined by a longitudinal plane that is aligned on said longitudinal axis and a pole of said hemispherical cross-section at a closed end of the partial toroid that extends toward a rear end of said shaped charge device, said liner having an outer surface and an inner surface, said inner surface exposed toward the open end of the front end of the shaped charge device and said liner producing an explosive hollow cylindrical jet stream directed toward said front of said shaped charge device substantially parallel to said longitudinal axis upon detonation of the shaped charge device;

a billet of high explosive material having a front end and a rear end located behind and proximate to the outer surface of said liner, said billet configured as a toroid with an internal aperture located proximate to the aperture of the liner, and said billet producing a high explosive detonation effect applied to said liner to produce said hollow cylindrical jet stream;

a coupler located in a rear portion of the shaped charge device, said coupler coupled to the rear end of the billet and said coupler producing a detonation wave initiating the high explosive detonation effect of the billet; and a body located around the outer surface of the billet and extending longitudinally the length of the billet, said body having a front end secured to said liner and, said body having a rear end secured to the coupler.

2. The shaped charge of claim 1, wherein the coupler initiates a high explosive detonation effect on the billet to direct the trajectory of said hollow cylindrical jet stream toward the longitudinal axis of the shaped charge device.

3. The shaped charge of claim 1, further comprising:

an attenuator located proximate to the aperture in the billet, said attenuator dampening a detonation wave.

4. The shaped charge of claim 1, wherein said coupler initiates a ring initiation at the rear end of the billet to produce the detonation wave and initiate the high explosive detonation effect of the billet.

5. The shaped charge of claim 1, wherein the coupler provides the critical alignment of the detonator with the coupler high explosive on the longitudinal axis of the shaped charge and provides the critical alignment of the coupler high explosive with the billet which to allow for a precise ring initiation of the billet.

6. The shaped charge of claim 1, further comprising:

a center body located proximate to the aperture of said liner and rearward of the billet toward the rear portion of the shaped charge device.

7. The shaped charge of claim 6, wherein the center body is hollow and provides a space for shock attenuation materials used to dampen shock waves.

8. The shaped charge of claim 7, wherein the space within the hollow center body can be used to contain a center projectile producing device.

9. An axisymmetric circular linear shaped charge device, comprising:

a liner configured in a partial toroid with a longitudinal axis extending lengthwise and intersecting an aperture located near the center of said partial toroid, said partial toroid being open-ended on a plane that intersects said longitudinal axis in a perpendicular manner toward a front end of the shaped charge device, said liner having a hollow hemispherical cross-section extending toward a closed end of the partial toroid as defined by a longitudinal plane that is aligned on said longitudinal axis and a pole of said hemispherical cross-section at a closed end of the partial toroid that extends toward a rear end of said shaped charge device, said liner having an outer surface and an inner surface, said inner surface exposed toward the open end of the front end of the shaped charge device and said liner producing an explosive hollow cylindrical jet stream directed toward said front of said shaped charge device substantially parallel to said longitudinal axis upon detonation of the shaped charge device;

a billet of high explosive material having a front end and a rear end located behind and proximate to the outer surface of said liner, said billet configured as a toroid with an internal aperture located proximate to the aperture of the liner, and said billet producing a high explosive detonation effect applied to said liner to produce said hollow cylindrical jet stream;

a coupler located in a rear portion of the shaped charge device, said coupler coupled to the rear end of the billet and said coupler producing a detonation wave initiating the high explosive detonation effect of the billet;

a body located around the outer surface of the billet and extending longitudinally the length of the billet, said body having a front end secured to said liner and, said body having a rear end secured to the coupler; and said shaped charge device producing an explosive hollow cylindrical jet upon detonation of said shaped charge device, said hollow cylindrical jet forming a hole in a target material that is wider than the outer diameter of the shaped charge device.

10. The shaped charge of claim 9, wherein the coupler initiates a high explosive detonation effect on the billet to direct the trajectory of said hollow cylindrical jet stream toward the longitudinal axis of the shaped charge device.

11. The shaped charge of claim 9, further comprising:

an attenuator located proximate to the aperture in the billet, said attenuator dampening a detonation wave.

12. The shaped charge of claim 9, wherein said coupler initiates a ring initiation at the rear end of the billet to produce the detonation wave and initiate the high explosive detonation effect of the billet.

13. The shaped charge of claim 9, wherein the coupler provides the critical alignment of the detonator with the coupler high explosive on the longitudinal axis of the shaped charge and provides the critical alignment of the coupler high explosive with the billet which to allow for a precise ring initiation of the billet.

14. The shaped charge of claim 9, further comprising:

a center body located proximate to the aperture of said liner and rearward of the billet toward the rear portion of the shaped charge device.

15. The shaped charge of claim 14, wherein the center body is hollow and provides a space for shock attenuation materials used to dampen shock waves.

16. The shaped charge of claim 15, wherein the space within the hollow center body can be used to contain a center projectile producing device.

17. A method of producing an axisymmetric cylindrical jet stream from a circular linear shaped charge device, comprising the steps of:

providing a liner configured in a partial toroid with a longitudinal axis extending lengthwise and intersecting an aperture located near the center of said partial toroid, said partial toroid being open-ended on a plane that intersects said longitudinal axis in a perpendicular manner toward a front end of the shaped charge device, said liner having a hollow hemispherical cross-section extending toward a closed end of the partial toroid as defined by a longitudinal plane that is aligned on said longitudinal axis and a pole of said hemispherical cross-section at a closed end of the partial toroid that extends toward a rear end of said shaped charge device, said liner having an outer surface and an inner surface, said inner surface exposed toward the open end of the front end of the shaped charge device;

positioning a billet of high explosive material behind and proximate to the outer surface of said liner, said billet being proximate to the aperture of the liner, and said billet producing a high explosive detonation effect applied to said liner;

positioning a coupler at a rear portion of the shaped charge device in contact with the rear of the billet, said coupler producing a detonation wave and initiating the high explosive detonation effect of the billet;

surrounding the shaped charge device with a body around the outer diameter of the billet and extending longitudinally the length of the billet; and producing an explosive hollow cylindrical jet stream with the liner that is directed toward said front of said shaped charge device substantially parallel to said longitudinal axis upon detonation of the shaped charge device.

18. The method of claim 17, wherein the coupler initiates a high explosive detonation effect on the billet to direct the trajectory of said hollow cylindrical jet stream toward the longitudinal axis of the shaped charge device.

19. The method of claim 17, further comprising the step of:

providing an attenuator proximate to the aperture in the billet, said attenuator dampening a detonation wave.

20. The method of claim 17, wherein said coupler initiates a ring initiation at the rear end of the billet to produce the detonation wave and initiate the high explosive detonation effect of the billet.

21. The method of claim 17, wherein the coupler provides the critical alignment of the detonator with the coupler high explosive on the longitudinal axis of the shaped charge and provides the critical alignment of the coupler high explosive with the billet which to allow for a precise ring initiation of the billet.

22. The method of claim 17, further comprising the step of:

positioning a center body proximate to the aperture of said liner and rearward of the billet toward the rear portion of the shaped charge device.

23. The method of claim 22, wherein the center body is hollow and provides a space for shock attenuation materials used to dampen shock waves.

24. The method of claim 23, wherein the space within the hollow center body can be used to contain a center projectile producing device.

25. The method of claim 17, further comprising the step of:

producing an explosive hollow cylindrical jet upon detonation of said shaped charge device, said hollow cylindrical jet forming a hole in a target material that is wider than the outer diameter of the shaped charge device.

* * * * *

UNITED STATES PATENT AND TRADEMARK OFFICE

CERTIFICATE OF CORRECTION

PATENT NO. : 9,335,132 B1
APPLICATION NO. : 14/181282
DATED : May 10, 2016
INVENTOR(S) : Nicholas Collier It is certified that error appears in the above-identified patent and that said Letters Patent is hereby corrected as shown below:

In the Claims
Claim 5, line 5 (Col. 13, line 23), delete "which"
Claim 13, line 5 (Col. 14, line 24), delete "which"
Claim 21, line 5 (Col. 15, line 18), delete "which"

Signed and Sealed this
Nineteenth Day of July, 2016

Michelle K. Lee

Michelle K. Lee
*Director of the United States Patent and Trademark Office*